US010603704B2

(12) United States Patent
Willems et al.

(10) Patent No.: US 10,603,704 B2
(45) Date of Patent: Mar. 31, 2020

(54) STRAIGHTENING APPARATUS AND METHOD OF CHANGING ROLLERS THEREOF

(71) Applicant: SMS GROUP GmbH, Duesseldorf (DE)

(72) Inventors: Markus Willems, Erkrath (DE); Sebastian Hausmann, Moenchengladbach (DE)

(73) Assignee: SMS GROUP GMBH, Duesseldorf (DE)

( * ) Notice: Subject to any disclaimer, the term of this patent is extended or adjusted under 35 U.S.C. 154(b) by 401 days.

(21) Appl. No.: 15/550,782

(22) PCT Filed: Mar. 8, 2016

(86) PCT No.: PCT/EP2016/054850
§ 371 (c)(1),
(2) Date: Aug. 29, 2017

(87) PCT Pub. No.: WO2016/142362
PCT Pub. Date: Sep. 15, 2016

(65) Prior Publication Data

US 2018/0036779 A1 Feb. 8, 2018

(30) Foreign Application Priority Data

Mar. 9, 2015 (DE) ..... 10 2015 002 887

(51) Int. Cl.
*B21B 31/08* (2006.01)
*B21D 1/02* (2006.01)
(Continued)

(52) U.S. Cl.
CPC ..... *B21D 1/02* (2013.01); *B21B 31/08* (2013.01); *B21B 31/10* (2013.01); *B21D 3/05* (2013.01); *B21D 37/147* (2013.01)

(58) Field of Classification Search
CPC ..... B21D 1/02; B21D 3/05; B21D 37/147; B21B 31/08; B21B 31/10
(Continued)

(56) References Cited

U.S. PATENT DOCUMENTS 5,941,115 A 8/1999 Minnerop et al.
6,041,637 A 3/2000 Tashiro
(Continued)

FOREIGN PATENT DOCUMENTS

JP 09024862 A 1/1997
JP 09248626 B 9/1997

*Primary Examiner* — David B Jones
(74) *Attorney, Agent, or Firm* — Andrew Wilford

(57) ABSTRACT

The invention relates to a straightening machine (1) for straightening an elongated semifinished product with straightening roller elements (6), with a roller table line (3) designed as a conveying section (4), with a stand device (7), which holds the straightening roller elements (6) with respect to the conveying section (4) and comprises a drive-side stand half (17) and an operator-side stand half (18), which is displaceable with respect to the drive-side stand half (17), with a changing device (25) for changing the straightening roller elements (6) and with a changing path (35), along which the straightening roller elements (6) can be moved for changing, in which machine the straightening roller elements (6) are movable on the one hand by means of the operator-side stand half (18) along a first segment (36) of the changing path (35), which extends in a horizontal displacement plane (20), and on the other hand by means of the changing device (25) along a further segment (37) of the changing path (35), which extends in a horizontal changing plane (32), characterized in that the horizontal changing plane (32) is arranged in the region of the physical vertical extent (40) of the operator-side stand half (18).

18 Claims, 5 Drawing Sheets

(51) Int. Cl.
*B21D 3/05* (2006.01)
*B21D 37/14* (2006.01)
*B21B 31/10* (2006.01)

(58) Field of Classification Search
USPC ..... 72/160
See application file for complete search history.

(56) References Cited

U.S. PATENT DOCUMENTS 6,354,127 B1 3/2002 Rossini
6,691,544 B2 * 2/2004 Steudle ..... B21C 47/18
242/559.4
6,910,360 B2 * 6/2005 Stjepan ..... B21F 3/02
140/3 CA
7,096,702 B2 * 8/2006 McDonald ..... B21D 5/08
72/181

* cited by examiner

STRAIGHTENING APPARATUS AND METHOD OF CHANGING ROLLERS THEREOF

CROSS REFERENCE TO RELATED APPLICATIONS

This application is the US-national stage of PCT application PCT/EP2016/054850 filed 8 Mar. 2016 and claiming the priority of German patent application 102015002887.1 itself filed 9 Mar. 2015.

The invention relates, on the one hand, to a machine for straightening an elongated semifinished workpiece with straightening rollers, with a roller table line forming a transport path, with a stand assembly holding the straightening rollers relative to the transport path that has a drive-side stand half and an operator-side stand half that is displaceable relative to the drive-side stand half, with a changing device for changing the straightening rollers, and with a changing path along which the straightening rollers can be moved for changing, wherein the straightening rollers can be moved, on the one hand, by the operator-side stand half along a first segment of the changing path that extends on a horizontal transport plane and, on the other hand, by the changing device along another segment of the changing path that extends on a horizontal changing plane.

On the other hand, the invention relates to a method of changing straightening rollers of a machine for straightening an elongated semifinished workpiece conveyed along a transport path of a roller table line of the straightening machine, where the straightening rollers are displaced laterally along a horizontal transport plane out of the roller table line or into the roller table line by an operator-side stand half of a stand assembly that holds the straightening rollers relative to the transport path, and the straightening rollers are made available for changing at a transfer station arranged laterally adjacent the table roller line.

Straightening machines of this generic type for straightening elongated semifinished workpieces or the like are sufficiently known from the prior art. These straightening machines comprise tools, namely straightening rollers, which are held or supported as sets in a stand assembly of the straightening machine. This straightening machine has two stand halves: a drive-side stand half that is connected in a substantially fixed manner to a drive of the straightening rollers, and an operator-side stand half that is displaceable relative to the drive-side stand half transversely to the roller table line of the straightening machine in order to open the stand assembly.

The elongated semifinished workpiece is straightened by the straightening rollers as it is conveyed longitudinally along a horizontal transport path or horizontal straightening section of a roller table line of the straightening machine. As a result of the contact with the elongated semifinished workpiece during the straightening process, however, the straightening rollers wear out and must therefore be changed out for fresh straightening rollers from time to time. In addition, the straightening rollers must be changed in the event of a product change if another elongated semifinished workpiece is to be straightened.

In order to change the straightening rollers, the stand assembly is opened by displacing the operator-side stand half laterally in the transverse direction relative to the drive-side stand half toward the operator side.

The straightening rollers are displaced by the operator-side stand half substantially in the direction of the horizontal straightening plane of the straightening section of the roller table line along a horizontal transport plane.

The straightening rollers are then grasped from above by a gripper of a changing manipulator of the straightening machine, lifted up from the horizontal straightening plane into a horizontal changing plane having a greater vertical height than the horizontal straightening plane or the horizontal transport plane, and thus removed from the operator-side stand half and transported away on the horizontal changing plane laterally beyond the operator-side stand half toward the operator side. The new straightening rollers are then inserted into the stand assembly in the reverse direction, and the straightening machine can resume its work with new straightening rollers.

While it is true that the straightening rollers on straightening machines can be changed without difficulty using the known changing manipulators, the changing procedure when using these changing manipulators is quite laborious.

In particular, the substantially different vertical levels relative to the actual horizontal straightening plane and horizontal transport plane and the vertically substantially higher horizontal changing plane represent a disadvantage, since this dictates a changing path that is very high and laterally beyond the operator-side stand half. In this regard, the changing path is disadvantageously very space-consuming, so that such straightening machines can usually only be used in relatively tall halls or buildings.

It is the object of the invention to further develop straightening machines of this type so as to enable at least the above-mentioned drawbacks to be overcome.

The object of the invention is achieved by a straightening machine for straightening an elongated semifinished workpiece with straightening rollers, with a roller table line forming a transport path, with a stand assembly holding the straightening rollers relative to the transport path that has a drive-side stand half and an operator-side stand half that is displaceable relative to the drive-side stand half, with a changing device for changing the straightening rollers, and with a changing path along with the straightening rollers can be moved for changing, the straightening rollers being movable, on the one hand, by the operator-side stand half along a first segment of the changing path that extends on a horizontal transport plane and, on the other hand, by the changing device along another segment of the changing path that extends on a horizontal changing plane, the straightening machine being characterized in that the horizontal changing plane generally at the physical vertical level of the operator-side stand half.

By virtue of the fact that the horizontal changing plane is in the region of the physical vertical level of the operator-side stand half, the changing device has a substantially more compact construction than in the prior art.

Expressed in another way: The horizontal changing plane lies substantially at the vertical level of the operator-side stand half.

The operator-side stand half thus extends physically through the horizontal changing plane.

It should already be pointed out at this juncture that the horizontal transport plane and the horizontal changing plane do not necessarily have to have the same vertical coordinates with respect to the vertical extent.

In particular, this means that the rest of the segment of the changing path no longer needs to extend above the operator-side stand half, as was previously the case, thereby significantly reducing the overall size of the changing device.

As a result, the straightening machine can be set up even in halls with lower ceilings that were previously deemed unsuitable for changing devices with changing manipulators having a conventional design.

In terms of the invention, the term "changing path" describes a path between a working station of the straightening rollers on the roller table line and a pickup position outside the stand assembly.

The first segment of the changing path is between this working station and a transfer station arranged within the stand assembly but outside of the roller table line.

In contrast, the additional segment of the changing path is between this transfer station and the pickup position, which is located outside of the straightening machine.

It will readily be understood that the straightening rollers to be changed out can be formed in a number of ways. Generally, a straightening roller is preferably formed by a roller body, an associated support sleeve, and other attachments.

This means that the straightening rollers are built in or mounted beforehand on the support sleeves. The straightening rollers are the actual tools of the straightening machine, working reciprocally with the elongated semifinished workpieces or the like.

In terms of the invention, the terms "transport plane" and "changing plane" describe horizontal planes that are arranged so as to extend substantially horizontally.

Herein, the term "vertical level" describes the overall physical height of the stand assembly, particularly of the operator-side stand half of the stand assembly that extends substantially perpendicular to the horizontal plane.

In order to enable the changing path to extend horizontally in as flat a manner as possible, it is advantageous if the changing path is completely within the vertical level of the operator-side stand half.

In other words, this means that the horizontal changing plane is not located above the operator-side stand half.

In this connection, it is advantageous if the present horizontal changing plane, like the horizontal transport plane, is substantially at the same vertical level as the horizontal transport path of the roller table line or the horizontal straightening plane lies, for example.

In this respect, it is advantageous if the horizontal transport plane and the horizontal changing plane are at the same vertical level.

It will readily be understood that the horizontal transport plane and the horizontal changing plane can also be arranged so as to be vertically offset with respect to one another within a certain framework. One tolerable measure for this can be said to be given if the horizontal transport plane and the horizontal changing plane are arranged so as to be mutually spaced apart by a vertical clearance that is less than a diameter of one of the straightening rollers. The vertical clearance is then generally less than 100 mm, for example.

Furthermore, it is advantageous if the changing device has interchangeable cradles that can supply sets of the straightening rollers along the horizontal changing plane to replace a set of rollers at the stand assembly. By these interchangeable cradles, the straightening rollers can be changed out in a compact manner advantageously substantially in the horizontal direction.

In terms of the invention, the term "interchangeable cradle" describes the arrangement on which one or preferably several straightening rollers can be deposited as a set of rollers for transport purposes. Such interchangeable cradles are often also referred to as cassettes in the context of straightening machines.

One preferred embodiment is that the changing device has at least one longitudinal conveyor with a longitudinal support extension extending parallel to the transport path of the straightening machine, with the longitudinal conveyor extending at least in part between the drive-side stand half and the operator-side stand half. This ensures that the longitudinal conveyor runs primarily in the direction of the transport path at least in the region of the stand assembly.

As a result of this, particularly the interchangeable cradles of the changing device can work together in an extraordinarily simple manner with the stand assembly, since it is very simple, structurally speaking, for the straightening rollers to be transferred from the operator-side stand half to the respective interchangeable cradle, or vice versa.

This longitudinal conveyor is thus an interchangeable cradle or a straightening roller or roller-set longitudinal conveyor.

In terms of the invention, the expression "longitudinal conveyor" refers to a device whose primary transport direction extends preferably substantially parallel to the transport path of the roller table line.

The transfer of straightening rollers between an interchangeable cradle and the operator-side stand half can be further simplified in a structural sense if the longitudinal support extension lies at the same or at approximately the same vertical level as the horizontal changing plane.

In the present case, in order to enable production costs to be kept low with respect to the changing device, slight differences in vertical level are tolerable, so that it is advantageous if the longitudinal support extension lies approximately at the same vertical level as the horizontal changing plane. For example, a difference in vertical level of about 100 mm or less is possible without any problem.

It will readily be understood that the longitudinal support extension need only extend from one single side into the stand assembly in order to enable the respective interchangeable cradle to be arranged in the transfer station between a drive-side stand half and the operator-side stand half.

It is especially expedient if the longitudinal support extension is through the stand assembly, since the longitudinal conveyor can thus be arranged on both sides of the stand assembly.

In this respect, it is advantageous if the longitudinal support extension is connected on both sides to the stand assembly.

For example, this enables an upstream longitudinal support extension to be implemented, for one, so that an interchangeable cradle equipped with new straightening rollers can travel horizontally between the drive-side stand half and the operator-side stand half. For another, an outlet-side longitudinal support extension can also be implemented so that an interchangeable cradle equipped with used straightening rollers can be extended horizontally out of the stand assembly.

In an alternative embodiment, a provision is made that the changing device has a transverse conveyor with a transverse conveyor section that can move the straightening rollers to a longitudinal conveyor of the changing device. In this way, the stand assembly with interchangeable cradles can be operated from only one side, so that the appropriately designed device can have an even more compact construction, particularly in its longitudinal direction.

Advantageously, the transverse conveyor is operatively connected by the longitudinal conveyor to the stand assembly, so that the interchangeable cradles can be transferred without any difficulty between the transverse conveyor and the stand assembly.

If the transverse support extension is at the vertical level of the horizontal changing plane, a changing path that, in the region of the transverse conveyor, is expanded additionally in the transverse direction to the roller table line of the straightening machine can still be flat.

In this respect, it is advantageous if the longitudinal support extension and the transverse conveyor section extend along a horizontal plane, namely preferably along the horizontal changing plane. As a result, the interchangeable cradles can be moved primarily along the horizontal plane, thus enabling lifting of the straightening rollers to a vertical level beyond the stand assembly to be completely prevented.

In another embodiment, the stand assembly, particularly the operator-side stand half, has a holder for supporting an interchangeable cradle, so that the interchangeable cradle can be displaced laterally to the roller table line along the first segment of the changing path on the transport plane. As a result, an interchangeable cradle can be made available while already bypassing the longitudinal conveyor at least to that effect, so that the used straightening rollers can be deposited more quickly from the operator-side stand half to the interchangeable cradle.

It can be especially space-saving to integrate the holder into the straightening machine, provided that the holder can be arranged in the roller table line beneath the transport path.

The object of the invention is also achieved by a method of changing straightening rollers of a straightening machine for straightening an elongated semifinished workpiece conveyed along a transport path of a roller table line of the straightening machine, the straightening rollers being displaced laterally along a horizontal transport plane out of the roller table line or into the roller table line by an operator-side stand half of a stand assembly that holds the straightening rollers relative to the transport path, the straightening rollers being made available in a transfer station for changing that is laterally adjacent the roller table line, the method being particularly characterized in that the straightening rollers are transferred in this transfer station from the operator-side stand half to an interchangeable cradle or vice versa, with the interchangeable cradle being moved along a horizontal changing plane into the transfer station or out of the transfer station.

Since the interchangeable cradle is moved into or out of the transfer station along a horizontal changing plane, the present method can be carried out at a significantly lower vertical level than was previously possible, substantially increasing the variety of potential places in which the straightening machine can be set up and operated.

It is especially advantageous if the interchangeable cradle is moved along the horizontal changing plane between the operator-side stand half and a drive-side stand half of the stand assembly that is opposite from the operator-side stand half. In this way, the respective interchangeable cradle can be extended horizontally into the straightening machine or out of the straightening machine in a structurally especially simple manner.

It is especially expedient if the interchangeable cradle, aligned with the transport path, is moved into the transfer station or out of the transfer station, since the interchangeable cradle can also be moved parallel to the longitudinal alignment of the stand assembly in this way.

Changing of the straightening rollers can be performed especially quickly if the straightening rollers are changed together as sets of rollers at the transfer station by an interchangeable cradle.

In one especially advantageous embodiment of the method, when the stand assembly is open, the interchangeable cradle is moved between the drive-side stand half and the operator-side stand half and then the interchangeable cradle is displaced by the operator-side stand half into the roller table line and placed beneath the transport path while an elongated semifinished workpiece is straightened by the machine.

The interchangeable cradle remains in the straightening machine between the two stand halves during production and, when the rollers are changed, is displaced together with the operator-side stand out of the roller table line and then moved out of the straightening machine parallel to the travel direction of the straightening machine with the used straightening rollers. Then, an interchangeable cradle fitted with a set of new straightening rollers is moved into the straightening machine and displaced together with the operator-side stand into the roller table line, where the interchangeable cradle also remains during production. In this way, an interchangeable cradle for holding used straightening rollers can be made available especially quickly at the straightening machine. In this connection, it is especially advantageous if the straightening rollers have already been fitted to the interchangeable cradle when the interchangeable cradle is displaced laterally out of the roller table line together with the operator-side stand half. The construction of the straightening machine can thus be simplified significantly. Furthermore, additional time can be saved, which means that the straightening machine is ready for use again more quickly.

It will readily be understood that it is also possible relative to this variant of the method to connect the stand assembly to the longitudinal conveyor with two sides or only with one side.

Possible specific variants that are possible in terms of the invention might be as follows:

Relative to a first variant of a changing concept with displaceable interchangeable cradles, an appropriately preassembled interchangeable cradle with new straightening rollers and/or support sleeves/straightening rollers is made available on the one hand and an empty interchangeable cradle for holding the straightening rollers that were previously in use is made available on the other hand parallel to the roller table line of the straightening machine in an inlet region, i.e., on the upstream end, and in an outlet region, i.e., on the downstream end, of the straightening machine or stand assembly thereof on rails of a rail of the longitudinal conveyor. The operator-side stand half of the stand assembly runs up transversely until the straightening rollers are in alignment with the waiting interchangeable cradles. Now the empty interchangeable cradle travels with a sufficiently dimensioned air gap between the lower guide rods and transport rings of the lower support sleeves of the straightening rollers into the opened stand assembly of the straightening machine. Particularly, additional aids on the stand assembly in the upstream or downstream end can guide upper guide rods to an upper support of transport rings of lower support sleeves. Here, the spacing between the upper guide rods and lower supports in the empty state of the interchangeable cradle corresponds roughly to the spacing between the upper and lower bearing surfaces, taking into account the air gap (pending travel) of the interchangeable cradle. After entry of the interchangeable cradle into the stand assembly, the threading aids can be removed by hand, for example. The interchangeable cradle can now be lifted from the rails. The upper guide rods preferably remain lying flexibly on the upper side of the transport rings of the lower support sleeves. Now, chocks with upper support sleeves can also be lowered until upper transport rings rest against upper guide rods. A gripping mechanism of support stubs for holding the support sleeves on the operator side stand half can be released, and the operator-side stand half travels further upward until the centering of straightening shafts has traveled completely out of the support sleeve. The interchangeable cradle is then lowered again to the rails. The interchangeable cradle loaded with the used straightening rollers now travels backward out of the opened stand assembly of the straightening machine until it reaches its initial position. Now the interchangeable cradle that is preassembled with the straightening rollers travels into the still open stand assembly of the straightening machine. The interchangeable cradle is lifted. The operator-side stand half continues to close until the straightening shafts are seated and centered in the new support sleeves of the new straightening shaft elements. The gripping mechanism grasps the support sleeves and pulls them to the operator-side stand half. The emptied interchangeable cradle is mm lowered onto rails. The upper chocks are lifted, so that the contact between the transport rings of the upper support sleeves and the upper guide rods is eliminated. The guide rods now rest only on the lower transport rings. Now the emptied interchangeable cradle can travel backward out of the opened stand assembly into its original initial position. Now the stand assembly closes again completely as the operator-side stand half travels toward the drive-side stand half. The gripping mechanism for holding the support sleeves on the operator side stand half can be released again. The straightening machine is thus ready for production again.

In this first variant, two possible embodiments are conceivable.

Depending on the available installation space, an empty interchangeable cradle for holding the straightening rollers to be changed and an already predrilled one for the installation of the new straightening rollers can be provided at the upstream and downstream ends of the straightening machine that then travel only parallel to the roller table line on the same longitudinal support extension in the opposite direction into the opened stand assembly of the straightening machine and out again.

Alternatively, it is also conceivable for the interchangeable cradles to travel only from one side, i.e. either from the upstream end or from the downstream end, into the opened stand assembly of the straightening machine and are then additionally displaced on a common substructure or platform transverse to the roller table line in order to appropriately position the required interchangeable cradle.

In contrast to this first variant, there is also a variant with an alternative changing concept with an at least temporarily stationary interchangeable cradle that offers the possibility of leaving the interchangeable cradle within the stand assembly, i.e. within the straightening machine below the straightening rollers, during production. During changing of straightening rollers, these straightening rollers then already slide downward onto the interchangeable cradle when the operator-side stand half travels upward. The interchangeable cradle is displaced transversely together with the operator-side stand half (coupling by catches, for example) and then extended analogously to the previously described first variant parallel to the roller table line out of the opened stand assembly of the straightening machine. Unlike in the first variant, it is therefore not absolutely necessary for the support sleeve to be clamped on the operator side stand half, thus simplifying construction.

Additional features, effects, and advantages of the present invention are explained on the basis of the enclosed drawing and the description that follows, in which a straightening machine with horizontal changing plane located within the vertical level of an operator-side stand half of a stand assembly is depicted and described for the sake of example.

Components in the individual figures that are the same at least in terms of their function are designated by the same reference symbols, with the components not necessarily being designated and clarified in all figures.

Figure 4:
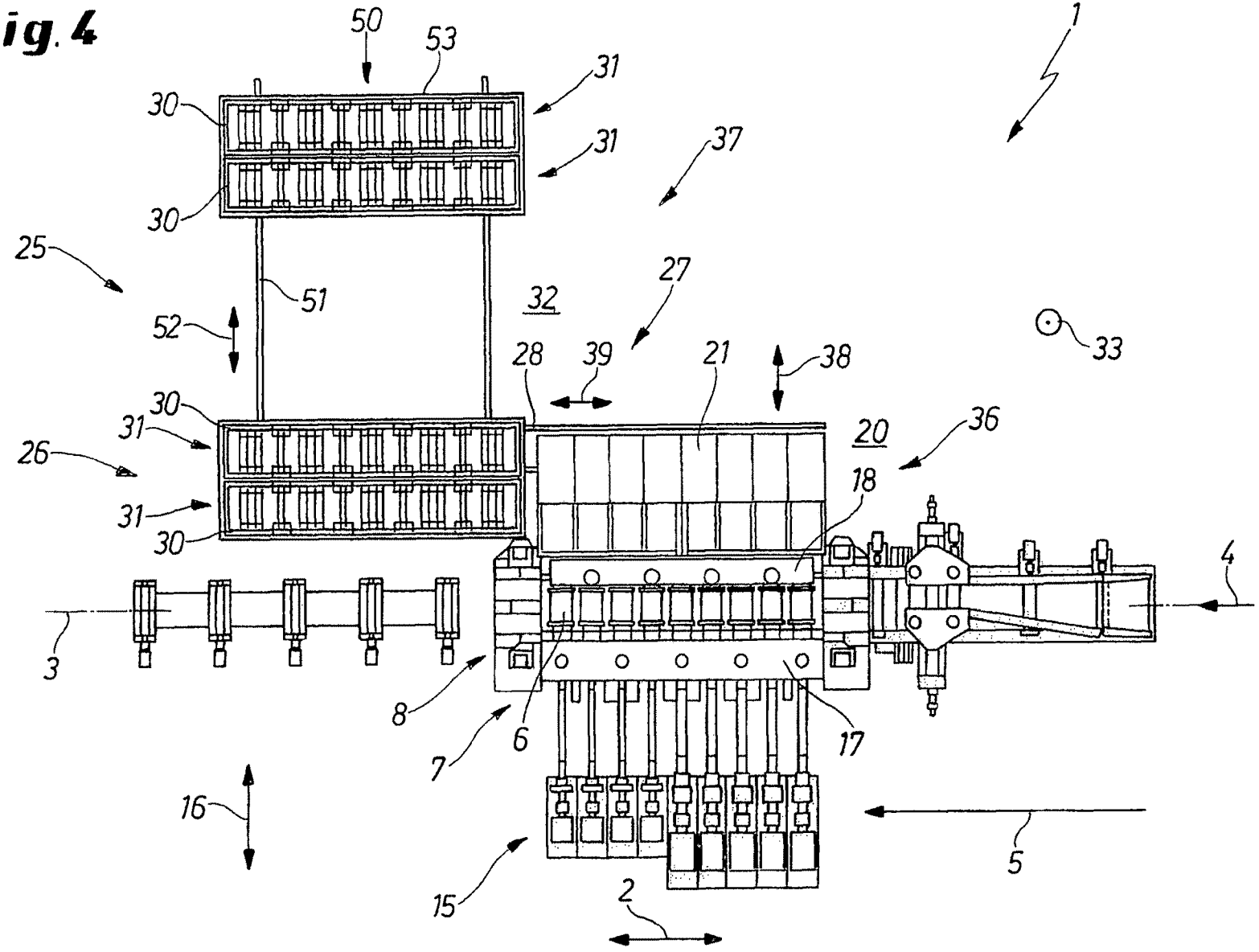
Figure 5:
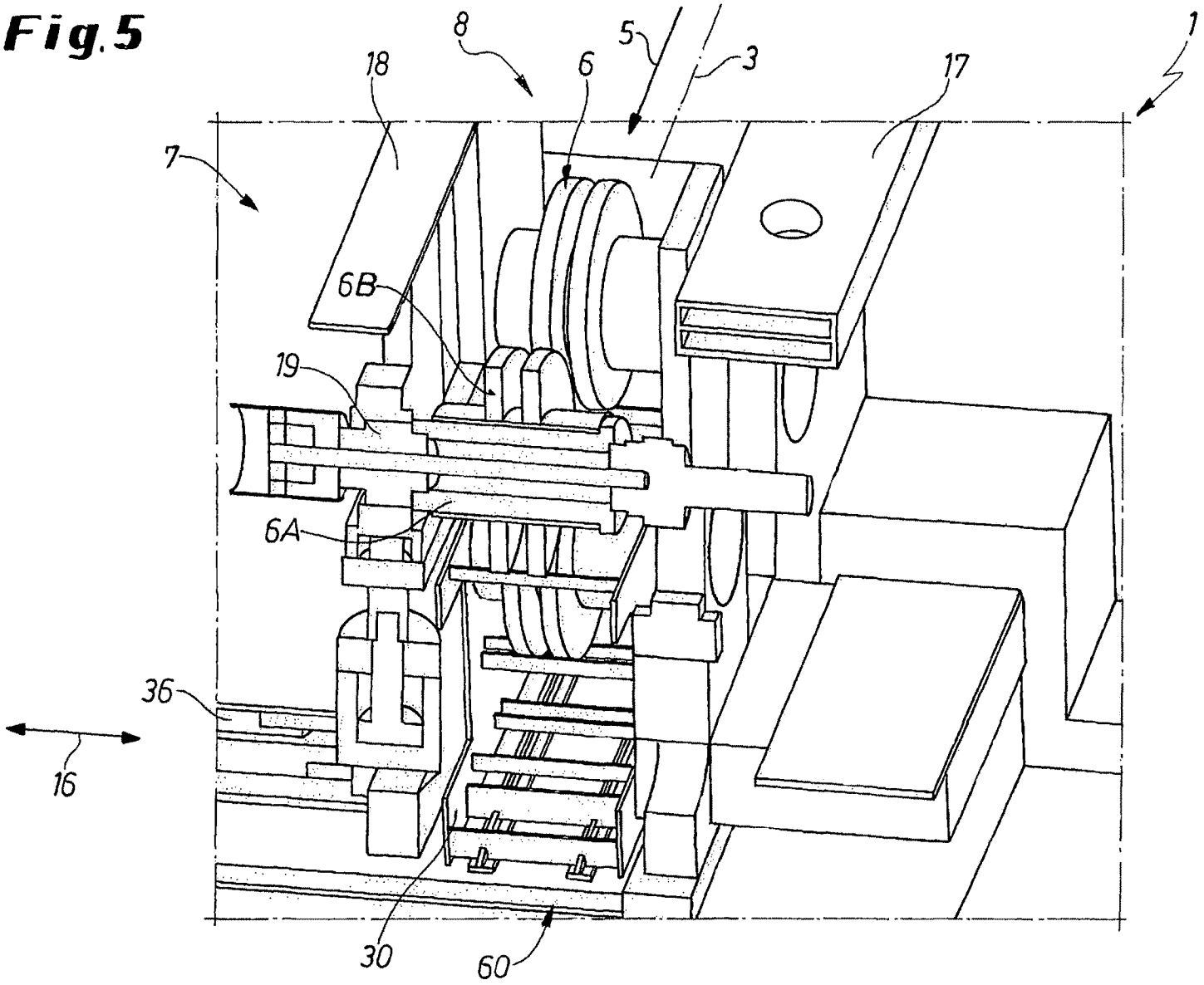

FIG. 4 is an additional schematic view of the straightening machine from FIG. 1 with an alternative changing device with one for longitudinal conveyor as well as a transverse conveyor that is additionally present; and FIG. 5 is a schematic, partially sectional view of the straightening machine from FIG. 1 or 4 modified such that at least one interchangeable cradle is temporarily positioned below the transport path of the roller table line of the straightening machine.

Figure 1:
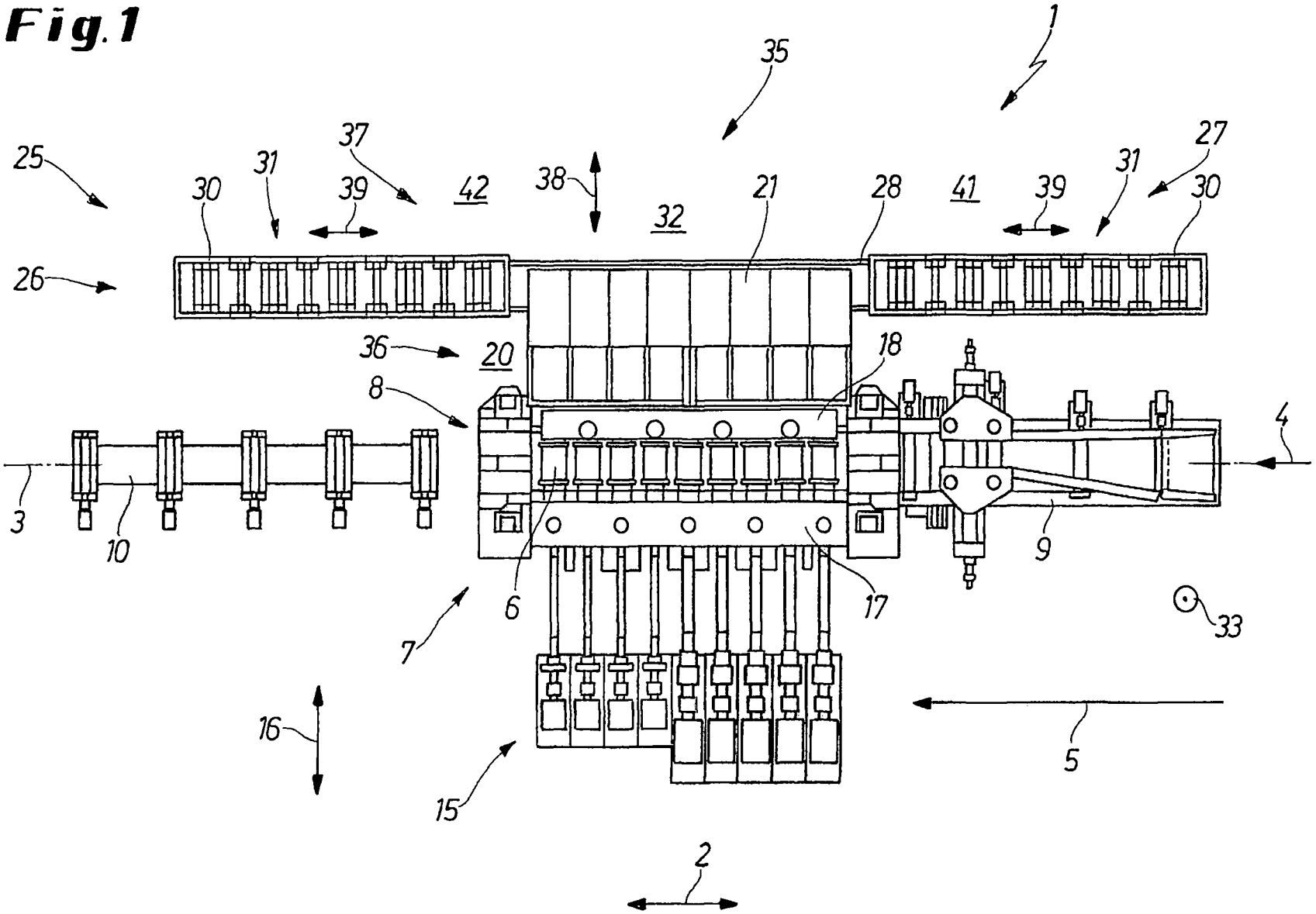
FIG. 1 is a schematic top view of a first straightening machine in which a device for changing straightening rollers has a longitudinal conveyor with a longitudinal support and transport section extending parallel to the transport path of the straightening machine and reaching into a stand assembly for holding straightening rollers.

The straightening machine 1 shown in FIG. 1 in a first embodiment is used to straighten an elongated semifinished workpiece (not shown), such as, for example, elongated profiles, brace beams (of high-speed rails, for instance) or the like. The straightening machine 1 shown particularly in FIG. 1 is specifically a horizontally rolling straightener (not numbered separately) of the CRS® (Compact Roller Straightener) type.

The straightening machine 1 has a roller table line 3 that extends in a longitudinal direction 2 of the straightening machine 1 that defines a transport path 4 of the straightening machine 1 along which the elongated semifinished workpiece is conveyed in a longitudinal travel direction 5 through the straightening machine 1.

The straightening machine 1 has a plurality of straightening rollers 6 (only some numbered for the sake of example).

These straightening rollers 6 are held in an inherently known manner in a working station 8 in the roller table line 3 in a stand assembly 7 of the straightening machine 1 such that the elongated semifinished workpiece is straightened as known per se upon passing through the straightening machine 1.

At least in this embodiment, the straightening rollers 6 are formed by support sleeves 6A and roller bodies 6B that (see only FIGS. 2 and 3) directly engage the elongated semifinished workpiece and thus are subject to wear. Therefore, the need exists to exchange these straightening rollers 6 on the straightening machine 1 as a function of wear. The straightening rollers 6 can be exchanged cumulatively or, alternatively, also depending on the shape of the elongated semifinished workpiece to be straightened—for example, if the straightening machine 1 is to be converted to a differently profiled elongated semifinished workpiece.

The roller table line 3 is thus predefined on the one hand by straightening rollers 6 that are successively arranged and held in the stand assembly 7 and, on the other hand, by an inlet roller table 9 which—when seen in the longitudinal travel direction 5—is upstream of the stand assembly 7, as well as by an outlet roller table 10 which, seen in the longitudinal travel direction 5, is downstream of the stand assembly 7.

The straightening machine 1 further has for rotating the individual straightening rollers 6 a drive 15 that is spaced transversely, i.e. in a transverse direction 16, from the stand assembly 7 and is thus located to the side adjacent the stand assembly 7. Since the drive 15 coupled with the individual straightening rollers is well known from the prior art, it will not be discussed further here.

The stand assembly 7 has a drive-side stand half 17 and an operator-side stand half 18. The drive-side stand half 17 is substantially fixed relative to the roller table line 3.

Figure 2:
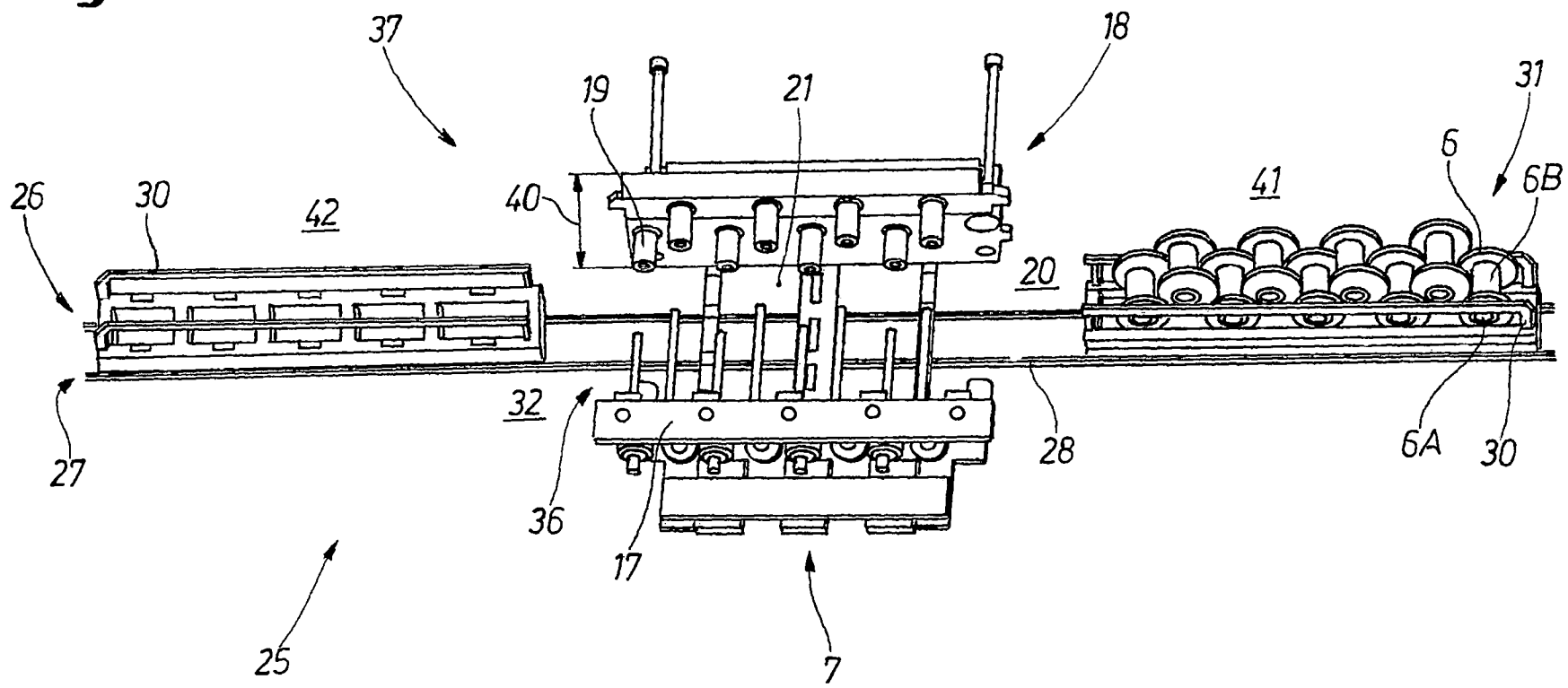
FIG. 2 is a schematic perspective view of the changing device at the stand assembly of the machine from FIG. 1.
Figure 3:
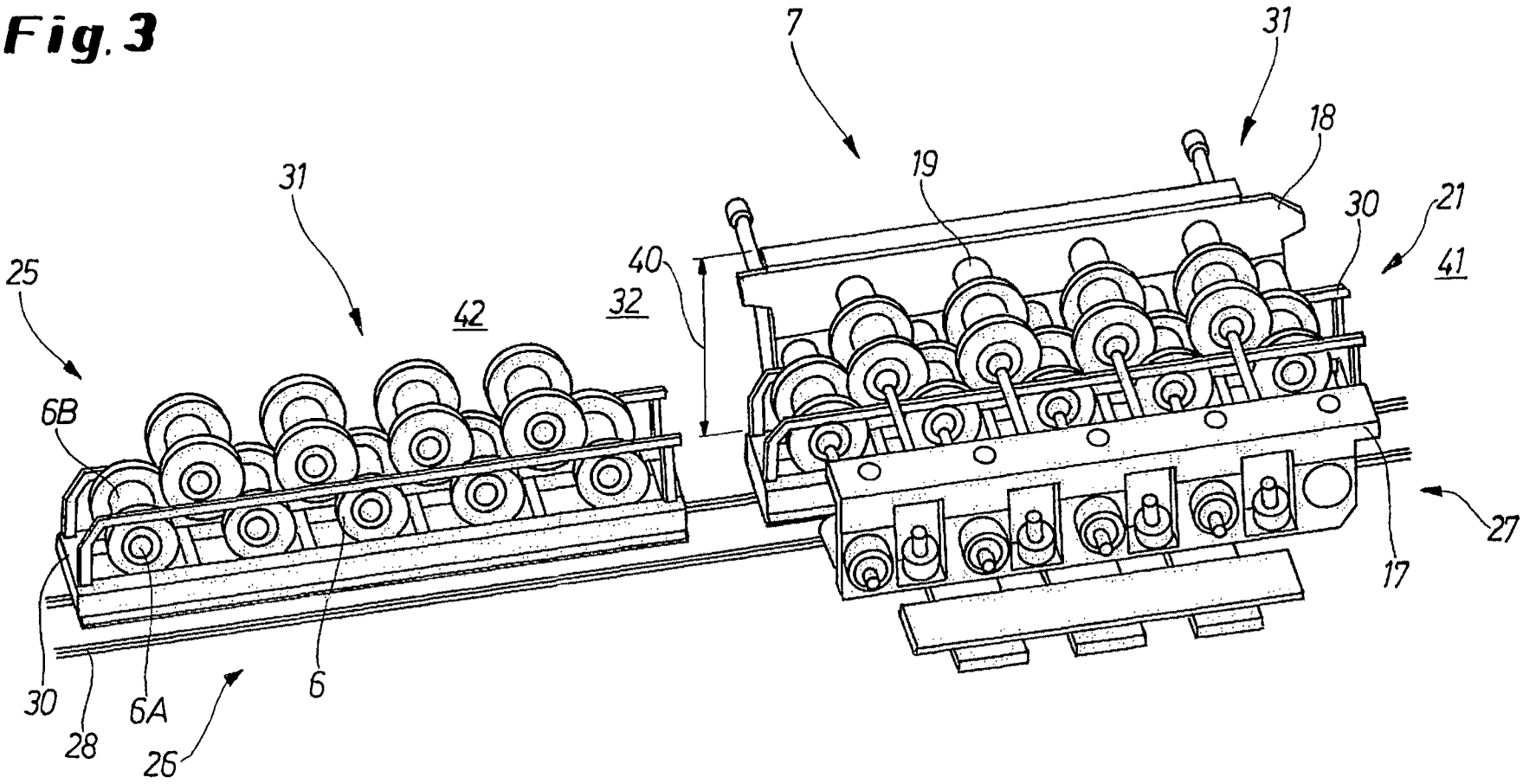
FIG. 3 is another schematic perspective view of the changing device shown in FIG. 2, with a set of used straightening rollers and with an additional set of new straightening rollers.

In contrast, the operator-side stand half 18 is transversely displaceable relative to the roller table line 3 and thus also to the drive-side stand half 17, so that the stand assembly 7 can be opened in the transverse direction 16, i.e. transverse to the transport path 5, in order to facilitate the exchange of the straightening rollers 6 (see FIGS. 2 and 3).

The straightening rollers 6 are held or supported on the operator-side stand half 18 on support stubs 19 (numbered only for the sake of example; see FIGS. 2 and 3) and can thus be moved by this operator-side stand half 18 transversely in a horizontal transport plane 20 relative to the transport path 4 out of the roller table line 3 and positioned in a transfer station 21 that is transversely adjacent the roller table line 3.

Moreover, the straightening machine 3 has a changing device 25 for changing the straightening rollers 6. This changing device 25 has at least one longitudinal support 26 which, in this embodiment, extends precisely parallel to the transport path 4 of the straightening machine 1.

This longitudinal conveyor 26 has a longitudinal support extension 27 that extends parallel to the transport path 4 of the straightening machine 1 and passes through the stand assembly 7 at least when the stand assembly 7 is open (see FIGS. 2 and 3). The longitudinal conveyor 26 is thus at least partially between the drive-side stand half 17 and the operator-side stand half 18, at least when the stand assembly 7 is opened sufficiently, thus enabling the straightening rollers 6 to be changed in accordance with the invention.

In this embodiment, the longitudinal support extension 27 is a rail 28. Moreover, the straightening machine 1 has interchangeable cradles 30 on which sets 31 of straightening rollers 6 can be deposited as sets 31 of rollers 6 (numbered only for the sake of example).

These interchangeable cradles 30 can be advantageously moved by the longitudinal conveyor 26 in a horizontal changing plane 32 between the drive-side stand half 17 and the operator-side stand half 18 parallel to the transport path 4 or the roller table line 3.

The interplay between the stand assembly 7 and the interchangeable cradles 30 in the horizontal transport plane 20 and the horizontal changing plane 32 are at substantially the same vertical level 33 that is parallel to the drawing plane of FIG. 1.

The present straightening machine 1 is thus characterized by a changing path 35 that has a first segment 36 that extends in the horizontal transport plane 20 and that has at least one additional segment 37 that also extends in the horizontal changing plane 32.

The first segment 36 of the changing path 35 extends between the working station 8 of the straightening machine 1 and the transfer station 21 of the straightening machine 1 and is realized by the transverse 1 travel stroke 38 of the operator-side stand half 18. The additional segment 37 of the changing path 35 extends between the transfer station 21 of the straightening machine 1 and another pickup position (not shown here) outside of the straightening machine 1 and is realized by a different longitudinal travel path 39 of the changing device 25 or of the longitudinal conveyor 26 thereof. The changing path 35, more precisely, at least the two segments 36 and 37 of this changing path 35, extends along a horizontal plane (not numbered separately), preferably the horizontal changing plane 32 that coincides approximately with the drawing plane.

By virtue of this horizontally extending, flat changing path 35, the changing device 25, unlike the known changing manipulators (not shown) of conventional straightening machines, is extraordinarily flat, so straightening machines 1 that are equipped with it can be set up even in low-rise buildings.

The changing device 25 can be constructed to be sufficiently low-profile if the horizontal changing plane 32 extends at a vertical level 40 of the operator-side stand half 18, since the straightening rollers 6 can thus be moved particularly parallel to the transport path 4 of the straightening machine 1 through the stand assembly 7.

As can be seen particularly from FIGS. 2 and 3, the longitudinal support extension 27 passes completely through the opened stand assembly 7 and between the drive-side and operator-side stand halves 17 and 18, so that the support extension 27 is extends longitudinally all the way through the stand assembly 7.

According to FIG. 2, one of the interchangeable cradles 30 with a new set of rollers 31 is placed on the upstream end 41 of the transfer station 21 longitudinally upstream of the stand assembly 7, which interchangeable cradle 30 can travel parallel to the transport path 4 between the drive-side stand half 17 and the operator-side stand half 18. For example, an empty interchangeable cradle 30 is positioned on the downstream end 42 of the transfer station 21 longitudinally downstream of the stand assembly 7 so that a used set 31 of straightening rollers 6 can be retrieved from the stand assembly 7. According to FIG. 3, an interchangeable cradle 30 with a new set 31 of straightening rollers 6 is between the drive-side stand half 17 and the operator-side stand half 18. This fresh set of rollers 31 is thus in the transfer station 21 and can be used by the straightening machine 1. An interchangeable cradle 30 with a set 31 of used straightening rollers 6 is also by way of example on the downstream end 42 of this transfer station 21.

In this first possible embodiment, the interchangeable cradles 30 enter the straightening machine 1 only during changing of the straightening roller, with a respective interchangeable cradle 30 being displaced next to the inlet and outlet roller tables 9 and 10 of the straightening machine 1 parallel to the longitudinal travel direction 5.

For changing straightening rollers, the operator-side stand half 18 travels transversely of the longitudinal travel direction 5 together with the straightening rollers 6 to be changed out of the roller table line 3. An empty interchangeable cradle 30 then enters the opened straightening machine 1 parallel to the roller table line 3, takes the worn roller bodies 6B with the support sleeves 6A and travels back into its starting position on the downstream end 42 of the transfer station 21. The second interchangeable cradle 30 can then move with the roller bodies 6B already preassembled on support sleeves 6A from the other side, here the upstream end 41, into the straightening machine 1 and transfers the new straightening rollers 6 to the operator-side stand half 18. This second interchangeable cradle 30 then also returns to its previous starting position, i.e., to the upstream end 41. Finally, the operator-side stand half 18 travels again together with the support sleeves 6A/roller bodies 6B transversely of the roller table line 3 and into the working station 8.

The changing of the straightening rollers 6 is thus carried out in a structurally and procedurally very simple manner. In this respect, the straightening rollers 6 have been transferred in the transfer station 21 from the operator-side stand half 18 to the interchangeable cradle 30 or vice versa, with the interchangeable cradle 30 having been moved along the horizontal changing plane 32 into the transfer station 21 or out of the transfer station 21.

In the other embodiment shown in FIG. 4, the changing device 25 of the straightening machine 1 is alternatively also equipped with a transverse conveyor 50. This transverse conveyor 50 has a transverse support extension 51 connected to the longitudinal support extension 27 of the longitudinal support 26.

In this respect, the transverse conveyor 50 is operatively connected by the longitudinal conveyor 26 to the stand assembly 7 of the straightening machine 1.

In the transverse conveyor 50 as well, the transverse support extension 51 is at the vertical level 33 of the horizontal changing plane 32, so that an interchangeable cradle 30 can be transferred without any difficulty from the transverse conveyor 50 to the longitudinal conveyor 26 or vice versa.

The transverse conveyor 50 also allows the stand assembly 7 to be operated from only one side.

In this other embodiment shown in FIG. 4, the interchangeable cradles 30 are also moved into the straightening machine 1 only during the actual changing of the straightening rollers, although interchangeable cradles 30 can be positioned on the upstream end 41 and downstream end 42 (see FIG. 1) on a common platform 53 that can be displaced in the transverse direction 52 to the longitudinal support extension 27 in order to also be displaced parallel to the transport path 4 after transfer to the longitudinal conveyor 26.

In principle, the changing of the straightening rollers is done in a manner that is similar to the first embodiment shown in FIGS. 1 to 3, although in the other embodiment that is shown in FIG. 4 the interchangeable cradles 30 are placed either only on the upstream end 41 (in particular, see FIG. 1) or only on the downstream end 42 (in particular, see FIG. 1) in order to optionally enable the present changing concept to be implemented even in extremely tight space conditions.

In the other embodiment that is shown in FIG. 5, the present straightening machine 1 is also modified to the effect that a holder 60 for an interchangeable cradle 30 is provided beneath the transport path 4 and/or beneath the working station 8. During operation, this interchangeable cradle 30 remains in the straightening machine 1 between the two stand halves 17 and 18 and, when the straightening rollers are to be changed, is displaced together with the operator-side stand half 18 out of the roller table line 3 and then parallel to the travel flow of an elongated semifinished workpiece with used straightening rollers 6 or used support sleeves 6A/roller bodies 6B out of the straightening machine 1. Then, an interchangeable cradle 30 that has already been fitted with new straightening rollers 6 is moved into the straightening machine 1 and displaced together with the operator-side stand 18 into the roller table line 3, where the interchangeable cradle 30 also remains stationary in the stand assembly 7 during production. In this way, an interchangeable cradle 30 for holding used straightening rollers 6 can be made available especially quickly at the straightening machine 1. It is possible for the straightening rollers 6 to already be at least in part on the interchangeable cradle 30 when the interchangeable cradle 30 is displaced laterally out of the roller table line 3 together with the operator-side stand half 18.

Express reference is made here to the fact that the features of the solutions that are described above and in the claims and/or figures can also be optionally combined in order to appropriately and cumulatively implement or achieve the described features, effects, and advantages.

It will readily be understood that the embodiments that are described above merely represent initial design options for a straightening machine 1 claimed in terms of the invention. The configuration of the invention is therefore not limited to these embodiments.

All of the features disclosed in the application documents are claimed as being essential to the invention insofar as they are novel in view of the prior art individually or in combination.

| List of reference symbols: | |
|---|---|
| 1 | straightening machine |
| 2 | longitudinal direction |
| 3 | roller table line |
| 4 | transport path |
| 5 | longitudinal travel direction |
| 6 | straightening rollers |
| 6A | support sleeves |
| 6B | straightening rollers |
| 7 | stand assembly |
| 8 | working station |
| 9 | inlet roller table |
| 10 | outlet roller table |
| 15 | drive |
| 16 | transverse direction |
| 17 | drive-side stand half |
| 18 | operator-side stand half |
| 19 | support stubs |
| 20 | horizontal transport plane |
| 21 | transfer station |
| 25 | changing device |
| 26 | longitudinal conveyor |
| 27 | longitudinal support extension |
| 28 | track section |
| 30 | interchangeable cradles |
| 32 | horizontal changing plane |
| 33 | vertical level |
| 35 | changing path |
| 36 | first segment |
| 37 | other segment |
| 38 | transverse travel path |
| 39 | longitudinal travel path |
| 40 | vertical level |
| 41 | upstream end |
| 42 | downstream end |
| 50 | transverse conveyor |
| 51 | transverse support extension |
| 52 | transverse direction |
| 53 | platform |
| 60 | holder |

The invention claimed is:

1. A machine for straightening an elongated semifinished workpiece with straightening rollers, the machine comprising:

a roller table line forming a transport path, a stand assembly holding the straightening rollers relative to the transport path having a drive-side stand half and an operator-side stand half displaceable relative to the drive-side stand half, a changing device for changing the straightening rollers, and a changing path along which the straightening rollers can be moved for changing, the straightening rollers being movable, on the one hand, by the operator-side stand half along a first segment of the changing path that extends on a horizontal transport plane and, on the other hand, by the changing device along another segment of the changing path that extends on a horizontal changing plane, the horizontal changing plane being generally vertically level with the operator-side stand half.

2. The straightening machine defined in claim 1, wherein the horizontal transport plane and the horizontal changing plane are at the same vertical level or at approximately the same vertical level with a difference in vertical level of less than 100 mm.

3. The straightening machine defined in claim 1, wherein the changing device has interchangeable cradles that can move sets of the straightening rollers along the horizontal changing plane for use as a set of rollers at the stand assembly.

4. The straightening machine claim 1, wherein the changing device has at least one longitudinal conveyor with a longitudinal support extension extending parallel to the transport path of the straightening machine, the longitudinal conveyor being at least in part between the drive-side stand half and the operator-side stand half.

5. The straightening machine defined in claim 4, wherein the longitudinal support extension lies vertically level with the horizontal changing plane.

6. The straightening machine defined in claim 4, wherein the longitudinal support extension is supported on both upstream and downstream sides of the stand assembly.

7. The straightening machine defined in claim 1, wherein the changing device has at least one transverse conveyor with a transverse support extension that can move the straightening rollers to a longitudinal conveyor of the changing device.

8. The straightening machine defined in claim 7, wherein the transverse conveyor is operatively connected by the longitudinal conveyor to the stand assembly.

9. The straightening machine defined in claim 7, wherein the transverse support extension lies at the same vertical level as the horizontal changing plane.

10. The straightening machine defined in claim 4, wherein the longitudinal support extension and the transverse conveyor section extend along the changing plane.

11. The straightening machine defined in claim 1, wherein the operator-side stand half has a holder for holding an interchangeable cradle, so that the interchangeable cradle can be displaced laterally to the roller table line along the first segment of the changing path on the transport plane.

12. The straightening machine defined in claim 11, wherein the holder is in the roller table line beneath the transport path.

13. A method of changing straightening rollers of a straightening machine for straightening an elongated semifinished workpiece conveyed along a transport path of a roller table line of the straightening machine, the method comprising the steps of:

displacing the straightening rollers laterally along a horizontal transport plane out of the roller table line or into the roller table line by an operator-side stand half of a stand assembly that holds the straightening rollers relative to the transport path, holding fresh straightening rollers in a transfer station for changing that is laterally adjacent the roller table line, transferring the straightening rollers in this transfer station from the operator-side stand half to an interchangeable cradle or vice versa, and moving the interchangeable cradle along a horizontal changing plane passing through the operator-side stand half into the transfer station or out of the transfer station.

14. The method defined in claim 13, further comprising the step of:

moving the interchangeable cradle along the horizontal changing plane between the operator-side stand half and a drive-side stand half of the stand assembly opposite from the operator-side stand half.

15. The method defined in claim 13, further comprising the step of:

moving the interchangeable cradle into alignment with the transport path into the transfer station or out of the transfer station.

16. The method defined in claim 13, further comprising the step of:

changing a set of straightening rollers with a set of rollers at the transfer station by the interchangeable cradles.

17. The method defined in claim 13, further comprising the steps, when the stand assembly is open, of:

moving the interchangeable cradle between the drive-side stand half and the operator-side stand half, and then displacing the interchangeable cradle by the operator-side stand half into the roller table line and placing the interchangeable cradle beneath the transport path while an elongated semifinished workpiece is straightened by the straightening machine.

18. The method defined in claim 13, further comprising the step of:

depositing the straightening rollers on the interchangeable cradle before the interchangeable cradle is displaced laterally out of the roller table line together with the operator-side stand half.

* * * * *